US007661840B1

(12) United States Patent
Eriksson

(10) Patent No.: US 7,661,840 B1
(45) Date of Patent: Feb. 16, 2010

(54) LIGHTING DEVICE WITH ILLUMINATED FRONT PANEL

(75) Inventor: Eric O. Eriksson, Glenview, IL (US)

(73) Assignee: iLight Technologies, Inc., Chicago, IL (US)

( * ) Notice: Subject to any disclaimer, the term of this patent is extended or adjusted under 35 U.S.C. 154(b) by 0 days.

(21) Appl. No.: 12/020,161

(22) Filed: Jan. 25, 2008

Related U.S. Application Data

(63) Continuation-in-part of application No. 11/763,777, filed on Jun. 15, 2007, now abandoned.

(60) Provisional application No. 60/805,372, filed on Jun. 21, 2006.

(51) Int. Cl.
*F21V 9/00* (2006.01)

(52) U.S. Cl. ..... 362/230; 362/231; 362/232

(58) Field of Classification Search ..... 362/800, 362/230–233
See application file for complete search history.

(56) References Cited

U.S. PATENT DOCUMENTS 4,600,910 A * 7/1986 Vanderlaan ..... 335/229
4,667,481 A 5/1987 Watanabe et al.
5,050,946 A 9/1991 Hathaway et al.
5,642,933 A 7/1997 Hitora
5,666,172 A 9/1997 Ida et al.
5,669,692 A 9/1997 Thorgersen et al.
5,697,175 A 12/1997 Schwartz
5,769,532 A 6/1998 Sasaki
5,786,665 A 7/1998 Ohtsuki et al.
5,803,579 A 9/1998 Turnbull et al.
5,876,107 A 3/1999 Parker et al.
5,883,684 A 3/1999 Millikan et al.
6,102,559 A 8/2000 Nold et al.
6,132,072 A 10/2000 Turnbull et al.
6,227,679 B1 5/2001 Zhang et al.
6,244,727 B1 6/2001 Ryan, Jr. et al.
6,305,813 B1 10/2001 Lekson et al.
6,371,637 B1 4/2002 Atchinson et al.
6,404,131 B1 6/2002 Kawano et al.
6,409,361 B1 6/2002 Ikeda
6,415,531 B1 7/2002 Ohtsuki et al.
6,447,132 B1 9/2002 Harter, Jr.
6,471,371 B1 10/2002 Kawashima et al.

(Continued)

FOREIGN PATENT DOCUMENTS

DE 4003539 8/1991

(Continued)

*Primary Examiner*—Anabel M Ton
(74) *Attorney, Agent, or Firm*—Stites & Harbison, PLLC; David W. Nagle, Jr.

(57) ABSTRACT

A lighting device generally comprises a housing, including a base portion and a side wall, which defines an interior cavity with an open end; a plurality of light-emitting diodes positioned within said interior cavity, each light-emitting diode emitting a light of a first hue; a plurality of bulbs, each said bulb being associated with and fitting over a respective light-emitting diode, each said bulb converting the light of the first hue emitted from the light-emitting diode into a light of a desired hue, which is then emitted from said bulb; and a front panel positioned at the open end of the housing and receiving light from the plurality of bulbs for illuminating the front panel.

14 Claims, 2 Drawing Sheets

U.S. PATENT DOCUMENTS 6,523,976 B1 2/2003 Turnbull et al.
6,536,914 B2 3/2003 Hoelen et al.
6,536,933 B1 3/2003 Gettemy et al.
6,550,949 B1 4/2003 Bauer et al.
6,577,073 B2 6/2003 Shimizu et al.
6,592,238 B2 7/2003 Hulse et al.
6,609,804 B2 8/2003 Nolan et al.
6,641,284 B2 11/2003 Stopa et al.
6,657,382 B2 12/2003 Nagai et al.
6,709,132 B2 3/2004 Ishibashi
6,762,562 B2 7/2004 Leong
6,800,996 B2 10/2004 Nagai et al.
6,834,979 B1 12/2004 Cleaver et al.
6,843,010 B2 1/2005 Robinson et al.
6,880,963 B2 4/2005 Luig et al.
6,953,262 B2 10/2005 Hulse et al.
6,988,813 B2 * 1/2006 Hoelen et al. ..... 362/601
7,005,679 B2 2/2006 Tarsa et al.
7,008,079 B2 3/2006 Smith
7,011,421 B2 3/2006 Hulse et al.
7,021,797 B2 4/2006 Minano et al.
7,036,956 B1 5/2006 Chou
7,052,152 B2 5/2006 Harbers et al.
7,063,449 B2 6/2006 Ward
7,086,756 B2 8/2006 Maxik
7,134,770 B2 11/2006 Barlian et al.
7,157,839 B2 1/2007 Ouderkirk et al.
7,158,020 B2 1/2007 Grady, Jr.
7,168,823 B1 1/2007 Jones
7,187,011 B2 3/2007 Tasch et al.
7,188,970 B2 3/2007 Hulse et al.
7,198,379 B2 4/2007 Ishibashi
7,205,719 B2 4/2007 Tain et al.
7,206,507 B2 4/2007 Lee et al.
7,207,691 B2 * 4/2007 Lee et al. ..... 362/231
7,264,366 B2 9/2007 Hulse
7,264,367 B2 * 9/2007 Hulse ..... 362/84
7,481,563 B2 * 1/2009 David et al. ..... 362/612
2001/0033488 A1 10/2001 Chliwnyj et al.
2001/0046131 A1 11/2001 Hoelen et al.
2002/0003700 A1 1/2002 Selkee
2002/0030992 A1 3/2002 Lefebvre et al.
2003/0002272 A1 1/2003 Suehiro et al.
2003/0174504 A1 9/2003 Tamaoki
2003/0198049 A1 10/2003 Hulse et al.
2003/0210552 A1 11/2003 Barlian et al.
2004/0004826 A1 1/2004 Wakaki et al.
2004/0027834 A1 2/2004 Chigusa et al.
2004/0042234 A1 3/2004 Otake
2004/0057234 A1 3/2004 Mohacsi
2004/0080938 A1 4/2004 Holman et al.
2004/0145895 A1 7/2004 Ouderkirk et al.
2004/0150991 A1 8/2004 Ouderkirk et al.
2004/0196643 A1 10/2004 Terada et al.
2004/0207341 A1 10/2004 Callahan
2005/0052871 A1 3/2005 Leu et al.
2005/0057917 A1 3/2005 Yatsuda
2005/0083713 A1 4/2005 Boks
2005/0168987 A1 8/2005 Tamaoki et al.
2005/0185421 A1 8/2005 Hayakawa
2005/0195603 A1 9/2005 Hulse
2005/0243550 A1 11/2005 Stekelenburg
2006/0028837 A1 2/2006 Mrakovich
2006/0039143 A1 2/2006 Katoh et al.
2006/0082999 A1 4/2006 Klein
2006/0138440 A1 6/2006 Jyo
2006/0193121 A1 8/2006 Kamoshita
2006/0193148 A1 * 8/2006 Bang ..... 362/607
2006/0221594 A1 10/2006 Thuot Rann et al.
2006/0262539 A1 11/2006 Goulet et al.
2006/0289884 A1 12/2006 Soules et al.
2007/0023763 A1 2/2007 Takigawa et al.
2007/0024191 A1 2/2007 Chen et al.
2007/0047227 A1 3/2007 Ducharme
2007/0086179 A1 4/2007 Chen et al.
2007/0120135 A1 5/2007 Soules et al.
2007/0215890 A1 9/2007 Harbers et al.
2007/0267976 A1 11/2007 Bohler et al.

FOREIGN PATENT DOCUMENTS

EP 0982532 3/2000
EP 1748498 1/2007
JP 2005197717 1/2007
JP 2007005091 1/2007
JP 2007005372 1/2007
JP 2007005522 1/2007
JP 2007005549 1/2007
JP 2007018815 1/2007
JP 2007035802 2/2007
JP 2007103160 4/2007
WO 0131255 5/2001
WO 0208799 1/2002
WO 2006121625 11/2006
WO 2007075393 7/2007
WO 2007049187 11/2007

* cited by examiner

LIGHTING DEVICE WITH ILLUMINATED FRONT PANEL

CROSS-REFERENCE TO RELATED APPLICATIONS

This application is a continuation-in-part of U.S. patent application Ser. No. 11/763,777 filed on Jun. 15, 2007, an application which itself claims priority to U.S. Provisional Patent Application No. 60/805,372, filed Jun. 21, 2006, the entire disclosures of which is incorporated herein by reference.

BACKGROUND OF THE INVENTION

The present invention relates to a lighting device with an illuminated front panel, with a plurality of light-emitting diodes (LEDs) serving as the light source, each LED including a bulb that fits over the LED, converting the light emitted from the LED into light of a desired hue.

For example, such a lighting device could be used as a channel letter, which is commonly constructed of an enclosure that outlines the desired shape, such as the shape of a letter or other alphanumeric character. The enclosure has a substantially flat rear surface for attachment to a building, and more importantly, is designed to house a light source such as an incandescent lamp, fluorescent lighting, or neon lighting. Finally, the front of the enclosure is open for receiving a substantially translucent lens. The lens is commonly tinted and diffuses light emanating from the light source, at least to some extent, and thus provides an illuminated letter or other shape.

For another example, such a lighting device could be used as a "light box" for illuminating a translucent, printed sheet. Specifically, like the above-described channel letter, such a light box is constructed of an enclosure. The enclosure has a substantially flat rear surface for attachment to a wall surface and is designed to house a light source such as an incandescent lamp, fluorescent lighting, or neon lighting. The front of the enclosure is open for receiving a substantially translucent panel, which serves to scatter and diffuse light emitted from the light source. The printed sheet is then secured to the front of the panel and is illuminated. Such a light box may be used in gaming machines, where a printed sheet of graphics is secured to the front of the panel of the light box. Such a light box may also be used for movie posters, with the movie poster secured to the front of the panel of the light box.

As mentioned above, the light sources typically used in constructing such a channel letter or a light box, such as fluorescent lighting or neon lighting, provide uniform and bright light typically devoid of hot spots; however, they have a variety of shortcomings. For example, such light sources often have a relatively short life, operate at high voltages, consume large amounts of energy, and/or are fragile. Additionally, with regard to neon lighting, it is both fragile and heavy, primarily due to its supporting infrastructure, making it expensive to package or ship. Moreover, it is extremely awkward to initially handle, install, and/or replace neon lighting.

LEDs have shown great promise to those interested in alternate light sources for various lighting products. LEDs are not only lightweight and resilient, but, when compared to other light sources, have a long life, operate at low voltages, and consume small amounts of energy. Thus, LEDs are now commonly used for a wide variety of general illumination and special effects illumination. For example, commonly assigned U.S. Pat. Nos. 6,592,238; 6,953,262; and 7,188,970, which are incorporated in their entirety herein by this reference, each describe an illumination device for simulating neon lighting having a plurality of spaced LEDs positioned adjacent the light-receiving surface of a rod-like member or waveguide. The rod-like member/waveguide is made of a material that preferentially scatters light entering the light-receiving surface such that the light intensity pattern exiting a light-emitting surface of the rod-like member/waveguide is substantially uniform.

However, the available visible color spectrum for illumination devices that use LEDs is limited by the finite availability of LED colors. Therefore, in commonly assigned U.S. Pat. Nos. 7,011,421; 7,264,366; and 7,264,367, each of which is also incorporated herein by this reference, illumination devices are described that use LEDs in conjunction with fluorescent and/or phosphorescent dyes, allowing for the emission of light in hues that cannot ordinarily be achieved through the use of LEDs alone.

SUMMARY OF THE INVENTION

The present invention is a lighting device with an illuminated front panel, with a plurality of light-emitting diodes (LEDs) serving as the light source, each LED including a bulb that fits over the LED, converting the light emitted from the LED into light of a desired hue.

An exemplary lighting device made in accordance with the present invention generally comprises a housing, a plurality of LEDs, a plurality of bulbs, and a front panel. The housing can be characterized as having side walls that extend outwardly from a base portion and terminate in a circumferential flange, thus defining an interior cavity. The LEDs are positioned within the interior cavity, for example, by mounting and electrically connecting them to a circuit board, which is then secured to the base portion of the housing.

Each bulb is associated with and fits over a respective LED, converting light of a first hue emitted from the LED into light of a desired hue, which is then emitted from and observed over the external surface of the bulb. Specifically, the bulb is composed of a light-transmitting material and a light color-converting material, such as some predetermined combination of one or more fluorescent dyes, phosphorescent dyes, and/or other dyes or colorants that are mixed into the light-transmitting material. Thus, the hue of the light emitted from and observed over the external surface of the bulb is usually some combination of the light of the first hue (directly from the LED) and the hue of the light emitted from light color-converting material (i.e., a second hue).

Through experimentation, Applicant has determined that certain geometries for the bulb help ensure that (a) the light emitted from each bulb has a generally uniform hue, at least along a front, light-emitting surface of the bulb, and (b) the front panel is effectively illuminated by the light emitted from the bulbs. For instance, one exemplary bulb has a length about twice the length of the housing of the LED over which its fits and a width just slightly greater than that of the housing of the LED over which its fits. Finally, the front, light-emitting surface of the exemplary bulb is a curved surface that extends from the top edge of a rear face of the bulb to the front edge of a bottom face of the bulb.

The bulb also defines an internal cavity adapted to receive and mate with the housing of an LED. The geometry of this internal cavity generally mirrors the shape of the housing of the LED, so that there is a relatively snug fit when the LED is fit into and received in the internal cavity. For instance, in one exemplary bulb, there are arc-shaped openings in the respective rear and bottom faces of the bulb, defining entry into the internal cavity. Thus, once the LED is received in the internal cavity, light will be directed through and out of the bulb, primarily through the front, light-emitting surface of the bulb. Again, the light color-converting material in the bulb converts the light emitted from the LED into light of a desired hue, i.e., a perceived color that is different than the color of light from the LED. The collective light from all of the bulbs then illuminates the front panel.

DETAILED DESCRIPTION OF THE INVENTION

The present invention is a lighting device with an illuminated front panel, with a plurality of light-emitting diodes (LEDs) serving as the light source, each LED including a bulb that fits over the LED, converting the light emitted from the LED into light of a desired hue.

For purposes of the discussion that follows, it is important to recognize that most perceived "colors" are not representative of light of a single wavelength, but rather some combination of wavelengths. In this regard, the dominant or perceived color of light comprised of some combination of wavelengths is generally referred to as hue. In order to provide a mechanism to represent and identify all possible perceived colors, the Commission Internationale l'Eclairage (CIE) constructed the CIE Chromaticity Diagram, which is based on three ideal primary light colors of red, green, and blue. The CIE Chromaticity Diagram is a well-known tool for identifying colors and is well understood by one of ordinary skill in the art. Specifically, since the x-axis of this CIE Chromaticity Diagram represents the amount of ideal red that would be mixed with ideal blue, and the y-axis of the CIE Chromaticity Diagram represents the amount of ideal green that would be mixed with ideal blue, a desired color can be identified in terms of its x and y coordinates. It is also important to recognize that the chromaticity curve, which is representative of the visible spectrum, is commonly superimposed over the chart such that wavelengths within the visible spectrum are represented along this curve.

Furthermore, the CIE Chromaticity Diagram is also helpful in understanding mixtures of primary light colors. Specifically, if a straight line is drawn between two points on the chromaticity curve, for example from green with a wavelength of 510 nm to red with a wavelength of 700 nm, that straight line illustrates the range of colors that could be created and perceived by the human eye, depending on the relative amounts of primary light colors in the mixture, including various yellowish-green colors and oranges. It is also important to recognize that the central region of the CIE Chromaticity Diagram is representative of white, a combination of the three ideal primary light colors. If any straight line between two colors on the chromaticity curve passes through this central region, those two colors can be mixed to create a perceived white color.

Figure 1:
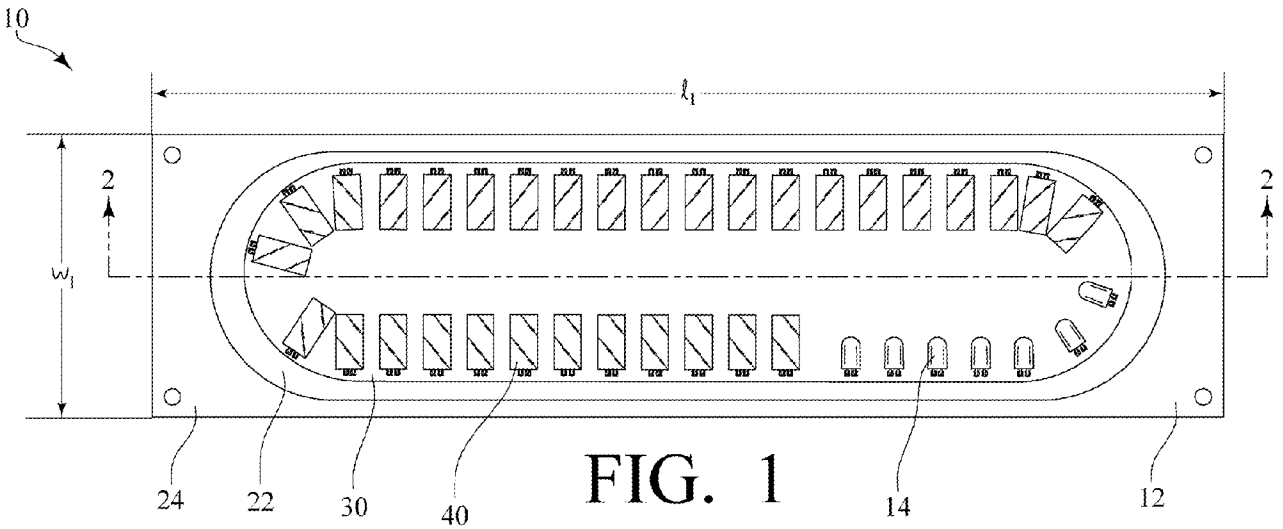
FIG. 1 is a plan view of an exemplary lighting device made in accordance with the present invention, with the front panel removed.
Figure 2:
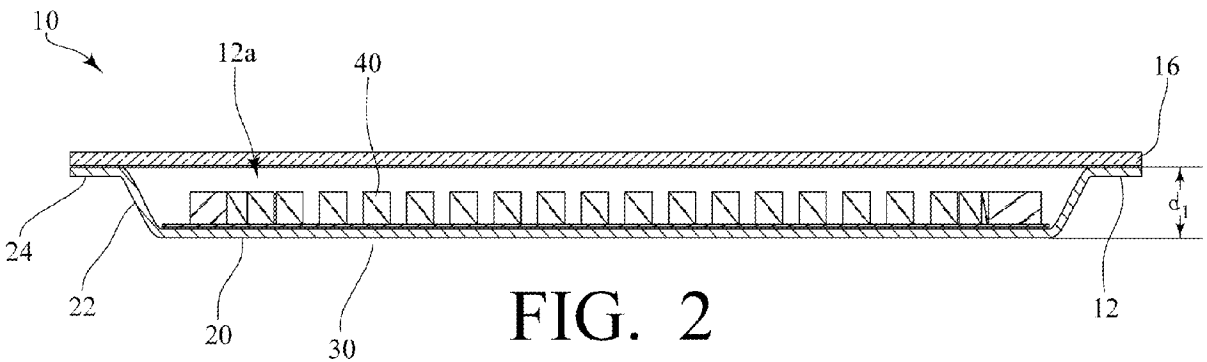
FIG. 2 is a side sectional view of the exemplary lighting device of FIG. 1, including the front panel, and taken along line 2-2 of FIG. 1.
Figure 4:
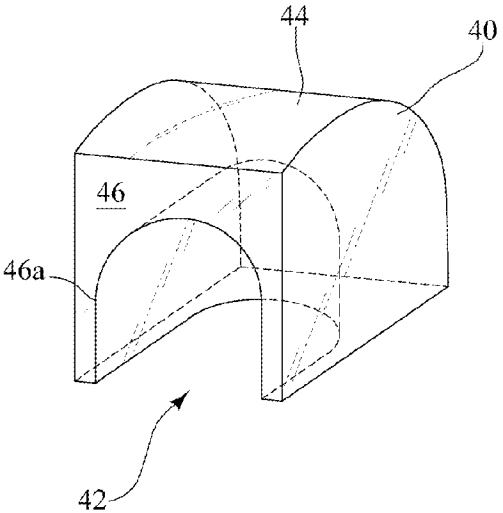
FIG. 4 is a perspective view of the exemplary bulb of FIG. 3.
Figure 6:
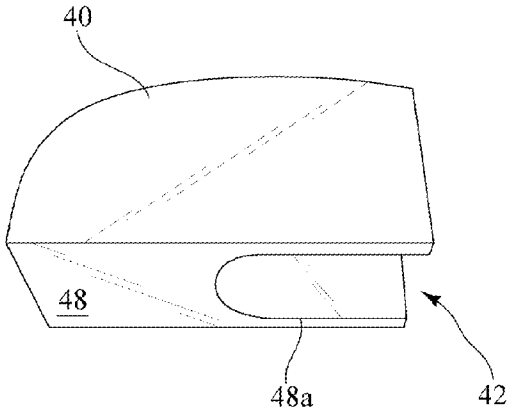
FIG. 6 is a bottom perspective view of the exemplary bulb of FIG. 3.

Returning to the present invention, and referring first to FIGS. 1 and 2, an exemplary lighting device 10 made in accordance with the present invention generally comprises a housing 12, a plurality of LEDs (as generally indicated by reference numeral 14), a plurality of bulbs (as generally indicated by reference numeral 40), and a front panel 16. In this exemplary embodiment, the housing 12 is formed from a single piece of plastic that has a generally rectangular perimeter with a width, $w_1$, of approximately 3 inches (76 mm) and a length, $l_1$, of approximately 11.5 inches (292 mm), and further defines an ovular, central recess for receiving the plurality of LEDs 14. In other words, the housing 12 can be characterized as having side walls 22 that extend outwardly from a base portion 20 and terminate in a circumferential flange 24, thus defining an interior cavity 12*a* having a depth, $d_1$, of approximately 0.875 inches (22.2 mm) with an open end. Of course, the above shapes and dimensions are solely for purposes of example and describe one exemplary embodiment. Others housings of various shapes and/or sizes could be used in constructing a lighting device in accordance with the present invention.

The LEDs 14 are positioned within the interior cavity 12*a*. In this exemplary embodiment, the LEDs 14 are mounted and electrically connected to a circuit board 30, which is then secured to the base portion 20 of the housing 12. The circuit board 30 is electrically connected to a remote power source and/or controller (not shown).

Each bulb 40 is associated with and fits over a respective LED 14, converting light of a first hue emitted from the LED 14 into light of a desired hue, which is then emitted from and observed over the external surface of the bulb 40. Specifically, the bulb 40 is composed of a light-transmitting material and a light color-converting material. For example, and as described in detail in U.S. patent application Ser. No. 11/945,691 filed on Nov. 27, 2007 and entitled "Bulb for Light-Emitting Diode" (an application which is incorporated herein by this reference), one suitable light-transmitting material is a translucent acrylic resin, for example, Plexiglas® Frosted DR-66080 White TL, manufactured and distributed by Arkema, Inc. of Puteaux, France and Philadelphia, Pa. (Plexiglas® is a registered trademark of Arkema, Inc.). When using such an acrylic resin, the light color-converting material may be some predetermined combination of one or more fluorescent dyes, phosphorescent dyes, and/or other dyes or colorants that are mixed into the light-transmitting material. For example, suitable fluorescent dyes include Lumogen™ F240 (orange), Lumogen™ F170 (yellow), Lumogen™ F285 (pink), and Lumogen™ 850 (green), each of which may be acquired from BASF Corporation of Mount Olive, N.J.

Thus, the hue of the light emitted from and observed over the external surface of the bulb 40 is usually some combination of the light of the first hue (directly from the LED 14) and the hue of the light emitted from light color-converting material (i.e., a second hue). In other words, unless all of the light emitted directly from the LED 14 is absorbed by the light color-converting material of the bulb 40, some of the light emitted directly from the LED 14 will continue through the bulb such that the observed light is a combination of the light of the first hue (from the LED 14) and the light of the second hue (from the light color-converting material). For example, the LED 14 may emit light having a wavelength in the blue region (short wavelength and relatively high energy) of the color spectrum, and the light color-converting material may be an orange fluorescent dye, such that the mixed light approximates the hue and intensity of a conventional tungsten filament light source, i.e., the desired hue is white.

Through experimentation, Applicants have determined that certain geometries for the bulb 40 help ensure that (a) the light emitted from each bulb 40 has a generally uniform hue, at least along a front, light-emitting surface of the bulb 40, and (b) the front panel is effectively illuminated by the light emitted from the bulbs 40. For instance, and referring now to FIGS. 3-6, one exemplary bulb 40 has a length, $l_2$, of approximately 15 mm, about twice the length of the housing of the LED 14 over which it fits. The exemplary bulb 40 has a width, $w_2$, of approximately 7 mm, just slightly greater than that of the housing of the LED 14 over which it fits. Finally, the exemplary bulb 40 has a height, $h_2$, of approximately 8 mm at its rear face. As best illustrated in FIG. 3, however, the height of the bulb 40 does slightly increase before gradually decreasing along the length, $l_2$, of the bulb 40, as the front, light-emitting surface 44 of the bulb 40 is a curved surface that extends from the top edge of a rear face 46 of the bulb 40 to the front edge of a bottom face 48 of the bulb 40.

Figure 3:
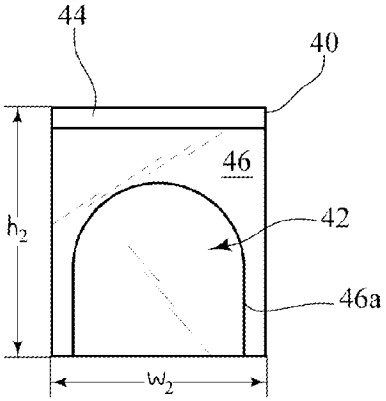
FIG. 3 is a front view of an exemplary bulb for use in a lighting device made in accordance with the present invention.
Figure 5:
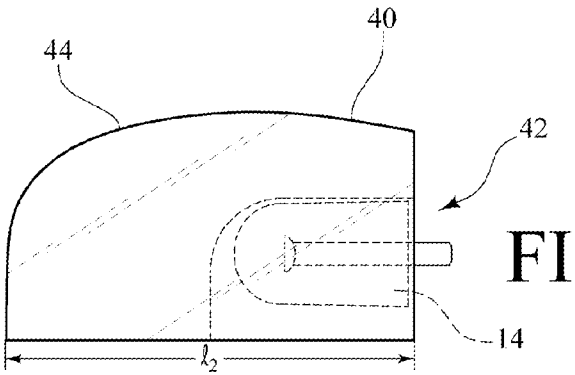
FIG. 5 is a side view of the exemplary bulb of FIG. 3.

The bulb 40 also defines an internal cavity 42 adapted to receive and mate with the housing of an LED 14 (as illustrated in phantom in FIG. 3). The geometry of this internal cavity 42 generally mirrors the shape of the housing of the LED 14, so that there is a relatively snug fit when the LED 14 is fit into and received in the internal cavity 42. For instance, in the exemplary bulb illustrated in FIGS. 3-6, there are arc-shaped openings 46*a*, 48*a* in the respective rear and bottom faces 46, 48 of the bulb 40, defining entry into the internal cavity 42. Thus, once the LED 14 is received in the internal cavity 42, as illustrated in FIG. 3, light will be directed through and out of the bulb 40, primarily through the front, light-emitting surface 44 of the bulb 40. Again, the light color-converting material in the bulb 40 converts the light emitted from the LED 14 into light of a desired hue, i.e., a perceived color that is different than the color of light from the LED 14.

Returning now to FIGS. 1 and 2, the LEDs 14 are positioned within the interior cavity 12*a* defined by the housing 12 of the lighting device 10. Specifically, the LEDs 14 are mounted and electrically connected to the circuit board 30, each in a generally horizontal orientation, i.e., parallel to the underlying circuit board 30. Accordingly, as a result of the arc-shaped openings 46*a*, 48*a* in the respective rear and bottom faces 46, 48 of the bulb 40, a bulb 40 can be readily "snapped" onto and fit over each LED 14 on the circuit board 30. Once a bulb 40 has been mated to each LED 14 in this manner, the front panel 16 can be placed over the open end of the interior cavity 12*a*, secured to and supported by the circumferential flange 24 of the housing 12.

Thus, light passes from each LED 14 through a respective bulb 40, with the color-converting material in the bulb 40 converting the light emitted from the LED 14 into light of a desired hue, i.e., a perceived color that is different than the color of light from the LED 14. The collective light from all of the bulbs 40 then illuminates the front panel 16.

As mentioned above, the front panel 16 may be constructed of a material to scatter and diffuse the light to help ensure substantially uniform illumination across the light-emitting surface of the front panel 16. For instance, Applicants have determined that the front panel 16 may also be constructed of the same acrylic resin as the above-described bulbs 40, for example, Plexiglas® DR Impact Grade Acrylic Resin.

One of ordinary skill in the art will also recognize that additional embodiments are possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

The invention claimed is:

1. A lighting device, comprising:

a housing, including a base portion and a side wall, which defines an interior cavity with an open end;

a plurality of light-emitting diodes positioned within said interior cavity, each said light-emitting diode emitting a light of a first hue;

a plurality of bulbs, each said bulb being associated with and defining an internal cavity for receiving a respective light-emitting diode, each said bulb being composed of a light-transmitting material and a light color-converting material, said light color-converting material converting the light of the first hue emitted from the light-emitting diode into a light of a desired hue, which is then emitted from said bulb; and a front panel positioned at the open end of said housing and receiving the light of the desired hue from said plurality of bulbs for illuminating the front panel.

2. The lighting device as recited in claim 1, wherein said light color-converting material is one or more fluorescent dyes.

3. The lighting device as recited in claim 1, wherein said light color-converting material is one or more phosphorescent dyes.

4. The lighting device as recited in claim 1, wherein said light color-converting material is a combination of fluorescent dyes and/or phosphorescent dyes.

5. The lighting device as recited in claim 1, wherein said light-transmitting material is an acrylic resin.

6. The lighting device as recited in claim 5, wherein said light color-converting material is one or more fluorescent dyes mixed into said acrylic resin.

7. A lighting device, comprising:

a housing, including a base portion and a side wall, which defines an interior cavity with an open end;

a plurality of light-emitting diodes positioned within said interior cavity, each said light-emitting diode emitting a light of a first hue;

a plurality of bulbs, each said bulb being associated with and fitting over a respective light-emitting diode, each said bulb being composed of a light-transmitting material and a light color-converting material, said light color-converting material converting the light of the first hue emitted from the light-emitting diode into a light of a desired hue, which is then emitted from said bulb; and a front panel positioned at the open end of said housing and receiving the light of the desired hue from said plurality of bulbs for illuminating the front panel;

wherein each said bulb defines an internal cavity for receiving a respective light-emitting diode, said internal cavity defined by openings through adjacent rear and bottom faces of said bulb, such that the bulb can be readily fit over the light-emitting diode.

8. The lighting device as recited in claim 7, wherein each said light-emitting diode is in a generally horizontal orientation parallel to the base portion of the housing.

9. The lighting device as recited in claim 7, wherein each said bulb includes a front, light-emitting surface which is a curved surface that extends from a top edge of the rear face of the bulb to a front edge of the bottom face of the bulb.

10. The lighting device as recited in claim 7, wherein said light color-converting material is one or more fluorescent dyes.

11. The lighting device as recited in claim 7, wherein said light color-converting material is one or more phosphorescent dyes.

12. The lighting device as recited in claim 7, wherein said light color-converting material is a combination of fluorescent dyes and/or phosphorescent dyes.

13. The lighting device as recited in claim 7, wherein said light-transmitting material is an acrylic resin.

14. The lighting device as recited in claim 13, wherein said light color-converting material is one or more fluorescent dyes mixed into said acrylic resin.

* * * * *